US005657547A

United States Patent [19]

Uttecht et al.

[11] Patent Number: 5,657,547

[45] Date of Patent: Aug. 19, 1997

[54] RATE GYRO WELLS SURVEY SYSTEM INCLUDING NULLING SYSTEM

[75] Inventors: Gary Uttecht; James Brosnahan; Eric Wright; Greg Neubauer, all of Houston, Tex.

[73] Assignee: Gyrodata, Inc., Houston, Tex.

[21] Appl. No.: 358,867

[22] Filed: Dec. 19, 1994

[51] Int. Cl.[6] ..... F21B 47/022; G01C 19/38; G01C 9/00

[52] U.S. Cl. ..... 33/304; 33/302; 33/313

[58] Field of Search ..... 33/304, 301, 302, 33/303, 312, 313, 1 H

[56] References Cited

U.S. PATENT DOCUMENTS

| | | | |
|---|---|---|---|
| 3,862,499 | 1/1975 | Isham et al. | 33/302 |
| 4,461,088 | 7/1984 | Van Steenwyk | 33/304 |
| 4,472,884 | 9/1984 | Engebretson | 33/312 |
| 4,524,324 | 6/1985 | Dickinson, III | 33/304 |
| 4,611,405 | 9/1986 | Van Steenwyk | 33/304 |
| 4,956,921 | 9/1990 | Coles | 33/304 |

*Primary Examiner*—Christopher W. Fulton

*Attorney, Agent, or Firm*—Gunn & Associates, P.C.

[57] ABSTRACT

A method for well borehole survey is set out. A sonde supports X and Y accelerometers and X and & sensors on a rate gyro having a Z axis aligned with the sonde. On a slickline, or within a drill string, the sonde is used to measure four variables, these being $G_x$ and $G_y$, $A_x$ and $A_z$. This enables well azimuth and inclination to determined. Measuring depth enables a survey to be made.

23 Claims, 2 Drawing Sheets

FIG. 2
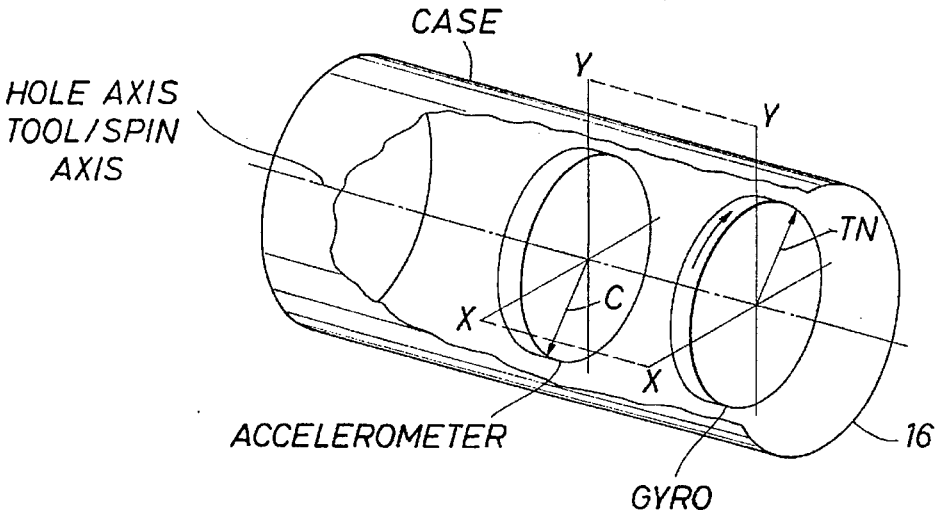
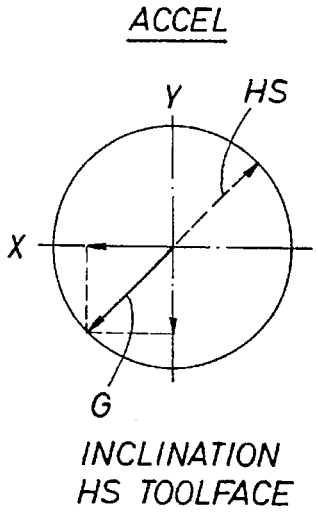
FIG. 3
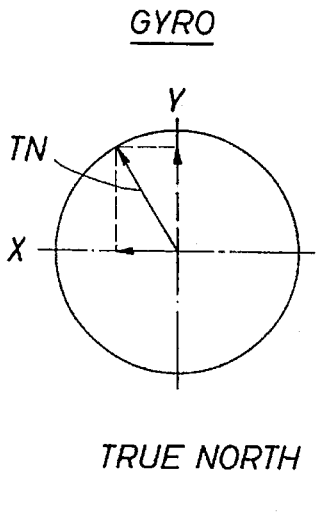
FIG. 4
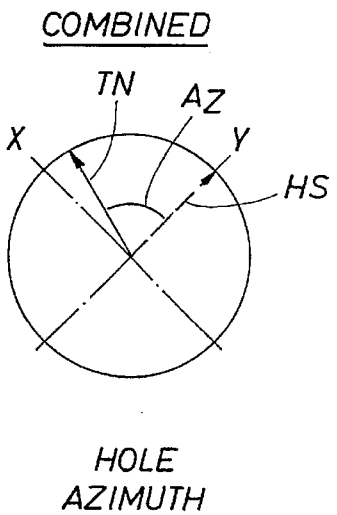
FIG. 5

RATE GYRO WELLS SURVEY SYSTEM INCLUDING NULLING SYSTEM

BACKGROUND OF THE DISCLOSURE

The present disclosure is directed to a rate gyro based survey device and a method of conducting a survey of a well borehole. In many instances, a well borehole is drilled which is substantially vertical. Rudimentary survey devices are used for such wells. By contrast, many wells are highly deviated. The well will define a pathway through space which proceeds from a centralized well head, typically clustered with a number of other wells, and extends in a serpentine pathway to a remote point of entry into a producing formation. This is especially the case with offshore platforms. Typically, an offshore platform will be located at a particular location. A first well is drilled to verify the quality of the seismic data. Once a producing formation is located, and is verified by the first well, a number of other wells are drilled from the same location. This is advantageous because it requires that the offshore drilling platform be anchored at a particular location. That is, the offshore drilling platform is anchored at a given site and several wells are then drilled from that site. The wells drilled from a single site will enter the producing formation at a number of scattered locations. As an example, consider a producing formation which is 15,000 feet in length and width and which is located at a depth of 10,000 feet. From a single location approximately near the center, it is not uncommon to drill as many as 30 wells or more to the formation. Consider as an example an offshore location in about 200 feet of water where drilling is conducted into the single formation from a single platform location. After the first well has been drilled, a template is lowered to the mudline and rested on the bottom. The template typically supports several conductor pipes, typically arranged in a grid pattern such as 4×8. This provides a template with 32 holes in the template. Conductor pipes are placed in the holes in the template. Below that, a deviated well is drilled for most of the wells. Some of the wells are deviated so that they are drilled at an angle of perhaps only 30° with respect to the horizon as the wells are extended out laterally in a selected direction. The wells enter the formation at predetermined points. This means that each well has a first vertical portion, a bent portion below the conductor pipe, and then a long deviated portion followed by another portion which is often vertical. So to speak, the well is made of serial segments in the borehole.

A survey is necessary to define the precise location of the well borehole. In most deviated wells, a free fall survey instrument typically is not used. Free fall survey instruments are used for fairly vertical wells. Where the vertical component is substantial and the lateral deviation is nil, survey instruments are readily available which can simply be dropped to obtain such data. Alternately, survey instruments are known which can be placed in the drill string at the time of retrieval of the drill string so that well borehole survey data is obtained as the drill string is pulled from the well borehole. This typically occurs when the drill bit is changed. The capture of accurate survey information is important, especially where the well is highly deviated. As an example, the well can be deviated where it extends at a 30° angle with respect to the horizon. It can have two or more large angular deflection areas. The well might terminate at a lateral location as much as 5,000 to 10,000 feet to the side of the drilling platform. Without regard to the lateral extent of the well borehole, and without regard to the azimuth or the depth of the well, it is important to obtain an accurate survey from such wells. In this instance, an accurate survey is required to enable drilling the well to the total depth desired and hitting the target entry into the producing formation. Typically, two or three surveys are required while drilling the well borehole. The surveys that are necessary enable correction to be undertaken so that the well can be further deviated to the intended location for the well.

In one aspect, the present disclosure sets forth a system which is able to be run on a slickline. The slickline is simply a support line to enable the survey sonde to be lowered to the bottom of the well borehole. The borehole path in space is located by the present system. In doing so, the sonde which encloses the equipment of the disclosure is lowered in either of two different fashions. In one instance, it can simply be lowered on the slickline within the drill string, and is then left at the bottom of the drill string, and then is moved incrementally upwardly as the drill string is pulled. Pulling the drill string is necessary in order to change the drill bit which is periodically required. In that sequence, the device is lowered to the bottom of the drill string and is landed just above the drill bit. At that juncture of proceedings, the sonde cannot precede any further because it is captured within the drill string and is too large to pass through the openings in the drill bit. The drill bit is normally replaced by pulling the drill string. The drill string is pulled by removing the topmost joints of pipe. Typically, the derrick is sufficiently tall so that three joints can be removed simultaneously. The three joints together comprise a "stand" which is placed in the derrick to the side of the rotary table. By this approach, the entire drill string is pulled incrementally moving the drill bit toward the surface for replacement. Each stand is approximately 90 feet in height. Therefore the drill bit is stationary for an interval sufficient to remove one stand, and these intervals are spaced at 90 feet in length. At each momentary stop in the process of removing a stand of the drill string, the drill bit is stopped and hence the sonde is stopped and obtains well borehole survey data. As additional stands of pipe are removed, this enables the sonde to stop and to obtain additional well borehole survey data. The data is measured at these stops while the survey is conducted.

In another procedure, the drill string is left in the well borehole. The sonde is lowered inside of the drill string to the bottom of the well borehole on a slickline, and is then pulled from the well borehole. In pulling, measurements are made by periodically stopping the sonde by stopping the slickline movement.

If the slickline remains inside of the drill string during rotation in the drilling phase, it can be readily severed. A line cutting device is available which can be placed on the slickline and which is permitted to fall to the bottom of the slickline. The inertial upset which occurs when the cutting device strikes bottom is sufficient to cut the slickline and thereby to enable retrieval of the slickline cutting apparatus and the slickline prior to resuming the drilling phase. This leaves the sonde in the drill pipe. It is left so that it can be retrieved along with the drill string. It is always found in the last joint of the drill stem (normally the bottom most drill collar) which is removed at the time that the drill string is pulled. As mentioned, pulling normally occurs during a trip to replace the drill bit.

The present disclosure sets forth an apparatus which particularly has an advantage in overcoming modest amounts of instrument drift. It utilizes a rate gyro as well as two accelerometers. Both devices provide measurements in orthogonal directions. In the preferred construction of the device, measurements are made in the X and Y dimensions. By definition, the Z dimension is coincident with the center line axis of the cylindrical sonde. Therefore X and Y define a plane at right angles with respect to the Z axis. There is a scale problem which arises from the use of a rate gyro mixed with accelerometers. The sensitivity of a gyro is enhanced compared with accelerometers. Typically, the signals from the rate gyro are approximately two orders of magnitude more sensitive. This means that instrument drift resulting from aging drift, temperature drift, drift as a result of vibration and the like are substantially amplified in the output signals from the rate gyro. One advantage of using a rate gyro is that the signal is so sensitive. It is however a detriment if the rate gyro signal is to be used in conjunction with signals from accelerometers. The present disclosure sets forth a mechanism in which the enhanced sensitivity of the rate gyro compared with the accelerometers is used to an advantage. One aspect of this derives from a mechanism which rotates the rate gyro housing 180°. The housing is coincident with the axis through the tool so that the rate gyro is rotated about the Z axis. If the rotation is precisely 180°, then the X and Y outputs from the rate gyro will be reversed. They will be reversed precisely thereby yielding the same output data with a reversal in algebraic sign. If a value is obtained denoted as +X, and a second value is obtained which is denoted as −X, then the algebraic sum of these two values should be zero in a perfect situation where no systematic error such as instrument drift occurs. Should there be a minor amount of error in the system such as drift or other error, the magnitude of the algebraic sum of these two values is dependent on the error, and more precisely is two times the error. This will be represented below as $2\Delta$. Knowing this, the error $\Delta$ can be isolated, and can then be eliminated from the data. Not only is this is true for the X dimension, it is also true for the Y dimension. Therefore both errors in X and Y can be overcome. This enables the presentation then of a rate gyro signal which is substantially free of that type of error.

The present disclosure takes advantage of onboard computing through a CPU which is provided with suitable power for operation by a power supply, and which works with data which is input to the CPU. The data from the rate gyro and the two accelerometers is written temporarily in memory. After a set of data is obtained, the set is then processed to reduce the amount of memory storage required. Speaking more specifically, in one aspect of the present disclosure, a set or ensemble of data is obtained. The number of measurements from each sensor output is represented by N where N is a positive integer. The integer is typically a multiple of two so that data processing is simplified. In one aspect of the present disclosure, N is typically 64, 128, 256, . . . . As will be seen, these represent values of N, where N is a multiple of two.

In summary, the present disclosure sets fourth a method and apparatus for obtaining survey data from a slickline supported tool which is maintained on the slickline or which is left in the drill string just above the drill bit. In both aspects, data is taken as the sonde which encloses the apparatus is pulled toward the surface, either on the slickline or on removal of the drill string from the well borehole. In both instances, data is captured by making multiple measurements at a given depth in the well borehole whereby N data from each sensor output are collected and processed. The data are obtained from X and Y accelerometers and X and Y output sensors on a rate gyro. This provides four sets of data. The data are stored temporarily in memory until the N data measurements are accumulated from each of the four sensor outputs. The sensors provide this data at one position, and then the rate gyro housing is rotated so that the data is provided from an alternate position. The alternate position is intended to be precisely equal and opposite. The second set of N data therefore provides data which ideally should subtract from the first set of data for the rate gyro. The N data are then averaged to provide four average values for each rate gyro orientation, two of which derived from the rate gyro and two of which are obtained from the accelerometers. This enables nulling to substantially reduce the highly amplified effects of drift and the error in the rate gyro data. The several data for each of the four sensors are statistically analyzed to provide the standard deviation. This is an indication of data quality.

DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may add to other equally effective embodiments.

FIG. 2 is a perspective view of the sonde showing the X and Y orientation of the gyro and accelerometer sensors with respect to the Z axis which is coincident with the sonde housing;

FIG. 3 is an X and Y plot of the output signals of the accelerometers with respect to an X and Y coordinate system showing how he gravity vector G impacts the sensors and thereby provides useful data;

FIG. 4 is a view similar to FIG. 3 for the gyro showing how a vector is located with indicates true north; and FIG. 5 is a combined coordinate system derived from FIGS. 3 and 4 jointly showing how true north cooperates with other measurements to thereby provide a indication of whole azimuth.

DETAILED DESCRIPTION OF THE PREFERRED EMBODIMENT

Figure 1:
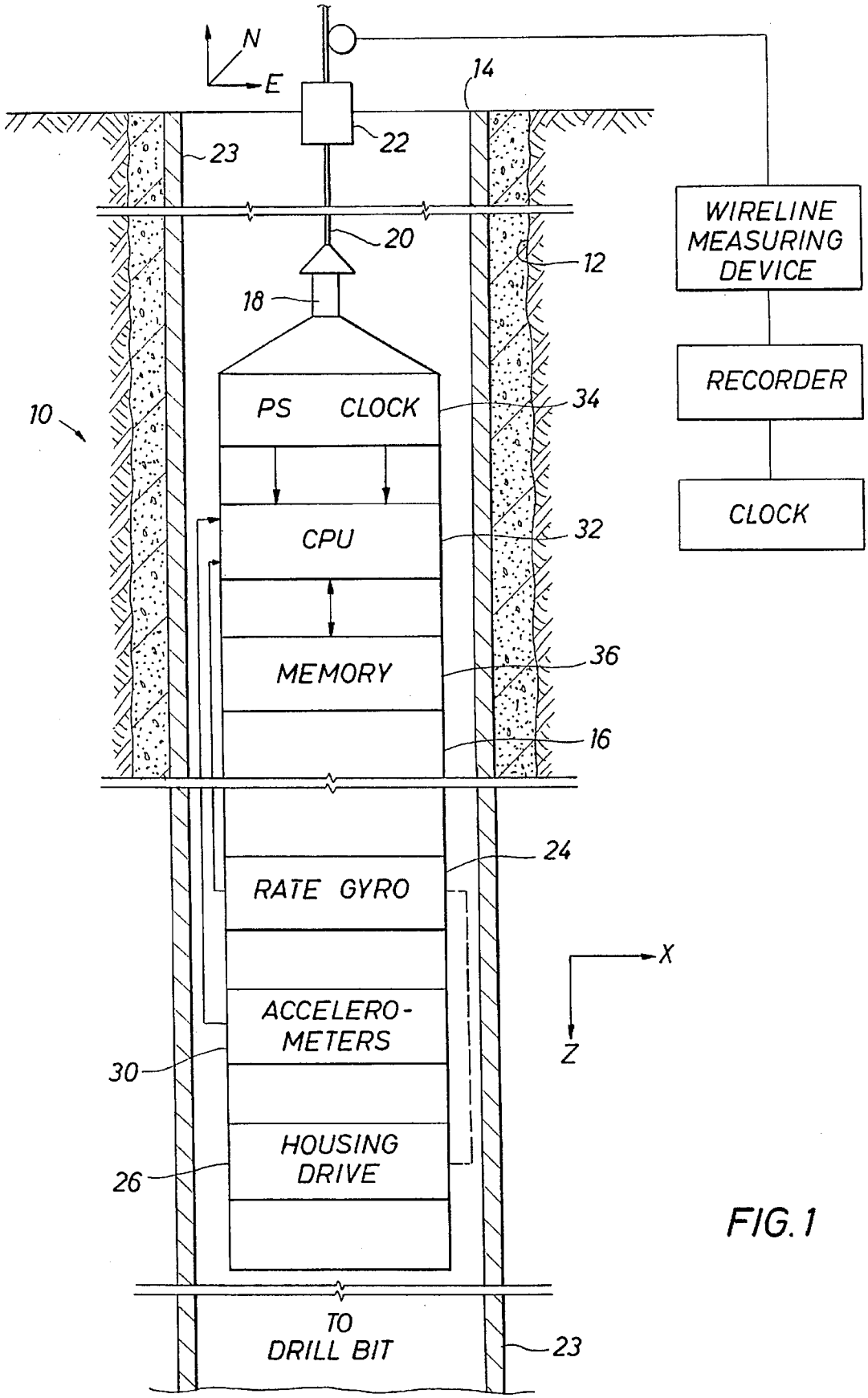
FIG. 1 is a schematic diagram of the sonde of the present disclosure supported in a well borehole on a slickline and further shows a relative reference system for the sonde and a surface located reference system.

Attention is first directed to FIG. 1 of the drawings where the numeral 10 identifies the apparatus of the present disclosure. It is shown in a well borehole 12 which extends into the earth from a well head location 14. At the well head, there is a reference system which is illustrated. At the surface, the reference system utilizes directional measurements, namely those on a compass rose. Ideally it is oriented to true north. In other words, to the extent that magnetic north is different from true north at different locations on the earth, it is preferable to use true north. Often, magnetic north can be measured and a simple adjustment incorporated because the deviation between true north and magnetic north is well known. The compass defines the orthogonal measurements as mentioned, and that therefore defines the vertical dimension also. The three references of course describe an orthogonal coordinate system.

The tool 10 is constructed in a cylindrical shape and is enclosed within a shell or housing known as a sonde 16. The sonde is for the protection of the apparatus located on the interior. The sonde at the upper end incorporates a fishing neck 18 for easy retrieval. It is incorporated so that a grappling type device can engage the fishing neck for retrieval. It is lowered into the well borehole on a slickline 20. The slickline does not include an electrical conductor. In that instance, it would normally be termed as a wire line because it includes one or more electrical conductors. Rather, it is a small diameter wire of sufficient strength to support the survey tool 10. The slickline extends to the surface. From the surface, the slickline is lowered into the well borehole. Typically, this must be done through a blow out preventor (not shown) to prevent pressure from blowing up through the well and out through the wellhead. The slickline, once the tool has been extended to the bottom of the well borehole, can be cut by placing a cutter device 22 on the slickline which travels to the bottom of the slickline. When it is stopped, the inertial upset associated with that sudden stop causes a cutter mechanism inside the cutter 22 to sever the slickline. The slickline can then be retrieved with the apparatus 22 clamped on the lower end of the slickline. In one other aspect, FIG. 1 has been simplified by omitting the drill string from the drawing representation in the immediate area of the depicted survey instrument 10. As a practical matter, the tool of the present disclosure is normally lowered within the interior of a drill string 23. It is lowered to the bottom drill string which is closed at the lower end by a drill bit. As will be understood, it is necessary to obtain a survey from a partly drilled well borehole. In the drilling of a well borehole, the drill string 23 supports the drill bit at the very bottom end of the drill string. The lowermost tubular member is typically a drill collar. At least one and sometimes as many as ten drill collars are incorporated.

The sonde 16 can be retrieved on the slickline 20 and measurements correlated to depth recorded by a measuring device having a measuring wheel 21 contacted against the line 20. The measurement data is stored by a recorder as a function of time.

The drill string is normally extended in the well bore hole until the point in time that the drill bit has worn. The rate of penetration is normally measured and this is some indication that the drill string needs to be pulled to replace a worn drill bit. The life of a drill bit is typically reasonably well known. The life of the drill bit, of course, is somewhat dependent on the formation materials being drilled at the moment; in this aspect of the present disclosure, the drill bit is pulled with the drill string and is replaced with a new drill bit of a selected type for continued drilling in a particular type formation.

The present disclosure particularly features the sonde 16 which is a sealed housing for the apparatus. It is able to operate in a steel drill pipe because it is not dependent on magnetically induced measurements. In other words, it is not necessarily responsive to the magnetic field of the earth. In that instance, it would require that the bottom most drill collar be formed of some nonmagnetic material. Such drill collars are quite expensive and can be avoided through the use of the present apparatus.

As further shown in FIG. 1 of the drawings, there is a tool related reference system. The Z dimension is coincident with the central axis of the elongate sonde 16. X and Y are dimensions at right angles as defined before. A rate gyro 24 is supported in the sonde 16 such that it is axially coincident with the central or elongate dimension of the sonde 16. The rate gyro is enclosed in a suitable housing. The housing, sensors, and rotating member of the rate gyro elements which can be discussed in schematic form because the rate gyro is a device well known in a number of applications including oil well survey equipment. In other words, the rate gyro need only be shown in schematic form. It incorporates a housing which encloses the moving components. The housing itself is mounted for rotation about the Z axis, and a housing drive 26 is included. This drive rotates the housing precisely through a 180° rotation. This rotation is about the Z axis or the axis of the sonde 16. The Z axis of the sonde is defined by the coordinate system previously mentioned, and hence rotation of the rate gyro about that axis provides measurements which will be discussed below, taking into account the X and Y dimensions in the tool related coordinate system.

In FIG. 1 of the drawings, the accelerometers 30 are also indicated in schematic form. As further illustrated, the housing drive 26 is connected with rate gyro 24 to provide the above described rotation. The data from the four sensors, two accelerometers 30 and two sensors associated with the rate gyro 24, are all input to the CPU 32. The CPU is provided with a suitable power supply and a clock 34 for operation. A program in accordance with the teachings of the present disclosure is stored in memory 36, and the data that is created during test procedures is likewise written in memory. When retrieved to the surface, the memory can be interrogated, and the data removed from the survey instrument 10 for subsequent and separate processing.

To better understand the present apparatus, attention is momentarily directed to FIG. 2 of the drawings. As shown there, the sonde including the sonde shell 16 is illustrated. In it, there are the two sets of sensors shown in symbolic form with particular emphasis on the X and Y coordinates for the two sets of sensors. As marked in FIG. 2, the X and Y dimensions are coincident. They differ in that the two sensor devices are offset along the length of the sonde. This offset does not impact the output data.

Going further with the structure shown in FIG. 2 of the drawings, there is imposed on the drawing the centerline axis through the sonde shell 16 which forms the protective jacket of the [survey instrument 10. Moreover the rate gyro which rotates in a plane transverse to the axis is likewise illustrated and a significant aspect of it is indicated, namely, the ability to locate true north illustrated by the symbol TN. Likewise, the two accelerometers are able to locate the gravity vector, illustrated by the symbol G, which is indicated in FIG. 2 of the drawings. Going more specifically however to the symbolic representations which are sent forth in FIGS. 3, 4, and 5 considered jointly, it will be seen that the accelerometers provide two outputs. They will be represented symbolically as $A_x$ and $A_y$. These are the two signals which are provided by the two accelerometers. In space, they define two resolved components of the gravity vector which is represented by the symbol G. As further shown in the drawings, the gravity vector which points toward the center of the earth defines an equal and opposite vector. That vector is represented by the symbol HS which refers to the high side of the tool face. The significance of that is understood with the explanation below.

FIG. 4 of the drawings shows the two output signals from the gyro which, as resolved components, defines a vector which points in the direction of true north represented by the symbol TN in FIG. 4. These representations shown in FIGS. 3 and 4 are combined in FIG. 5 of the drawings. True north is useful for orienting the measuring instrument 10 in space. Once that is known in conjunction with vector HS, the hole azimuth can be determined. The hole azimuth is represented by the vector $A_z$. The representations in FIGS. 3, 4, and 5 are significant in describing operation of the device of this disclosure.

One important feature of the present apparatus is brought out by the method of operation. Consider a first set of readings which is obtained by use of the survey tool which is shown in FIG. 1 of the drawings. Assume for purposes of discussion that the survey tool 10 is lowered on a slickline 20 to the bottom of a drill string 23 and is left resting on the bottom the drill string just above the drill bit. At that location, the sonde is then located so that data can be obtained from a first location in the well borehole. Through the use of the present apparatus, measurements are obtained which are represented as $A_x$, $A_y$, $G_x$, and $G_y$. Preferably, many measurements are made, the number being represented by N, and they are recorded in memory. Assume for purposes of discussion that N data points is 128 or 256. Through the use of conventional statistical programs readily available, all of the data from each sensor output at a given tool depth in the well borehole is collectively analyzed and the standard deviation of the four variables is then obtained. The standard deviation is recorded along with the average value. While N data are obtained for all the four variables at a given depth, the data are reduced to single values so that each of the four variables are individually and uniquely represented.

As one example, assume that the sonde 16 is lowered to precisely 10,000 feet in the well borehole and a set of data is obtained. Assume also that N is 256. 256 entries are recorded in memory for each of the four variables. Then, the four variables are averaged and the standard deviation for each of the four is also obtained.

At this juncture, the data derived from the rate gyro includes averaged values of $G_x$ and $G_y$. The next step is to rotate the gyro housing. N measurements from each sensor again are made. These measurements are made after rotation and ideally are measurements which are equal and opposite the first measurements. The second set of N data from each of the four sensor outputs is likewise averaged, and the standard deviation is again determined. The first average value for $G_x$ is then compared with the second average value of $-G_x$. When the two are added, the algebraic sum should be zero if no systematic instrument error (such as drift) is present. In other words, the magnitude of the average of second set of data is subtracted from the magnitude of the average of the first set of data from the rate gyro measurements.

Any small error which is obtained upon subtraction of the two values is primarily a function of error in the equipment, which is usually sensor drift. These error differences can be useful in evaluating the quality of the data.

The foregoing routine should be considered with respect to the position of the measuring instrument 10 in the well borehole. Data is preferably collected from the bottom to the top. To do this, at the time that a drill string is to be pulled on a trip to replace the drill bit, the measuring instrument 10 is pumped down the drill string supported on the slickline. When it lands at the bottom, the line is severed and retrieved so that it will not connect the several stands of pipe together. A first data set consisting of measures of $G_x$, $G_y$, $A_x$, and $A_y$ is collected. This is collected while the drill bit is at bottom. This is accomplished when the drill string is not rotating. The averages are obtained for values of $G_x$, $G_y$, $A_x$, and $A_y$. In addition, the standard deviation for all four measurements is likewise obtained, thereby representing eight data values, four being the average measurements and four being the standard deviation of those measurements. The housing is then rotated and the second set of measurements are obtained. These are the measurements of $-G_x$ and $-G_y$. They are recorded for later subtraction, or they can be automatically subtracted by the CPU.

The collection of data requires a finite interval. The N(=256) measurements process is done in a few seconds. Earth movement continues while collecting the data long the well. The N measurements are taken at M depths.

The term M represents the number of measurements made at a specified depth along the well borehole. An example will be given below which involves 100 measurements or M=100.

The averaged measurements and deviation data are stored and are subsequently retrieved when the tool 10 is brought to the surface. Assume for purposes of description that the well is 9,000 feet in depth. The drill stem is made of typically 90 foot stands of pipe so that data from M=100 depths are obtained. The first set of N data are collected while the drill bit is on bottom and the second set of N data is collected after rotation of the gyro housing before the drill bit is raised by removal of the first stand of pipe. This can be continued indefinitely until the entire drill stem has been removed to enable bit replacement. This will create M survey points in the 9000 feet of borehole.

At each stopping place for the drill string where the drill string is suspended while another stand of pipe is removed from the drill string, the housing is rotated so that two sets of gyro data are obtained. This is repeated until the drill bit is brought to the surface. The measuring instrument 10 of the present disclosure is carried up the borehole in the bottom most drill collar resting on top of the drill bit. The sonde 16 is then removed and connected to a suitable output cable to enable transfer of the measured data out of the sonde into another memory device. This enables the data to be further analyzed and used in plotting a survey of the well borehole.

As noted from the foregoing, one important advantage of the system is that a set of N data for each sensor output is obtained with the housing positioned in one direction or orientation and then another set of N data is obtained with the housing rotated by 180°. This is done repetitively as the drill string is pulled.

The present system is not susceptible to distortions which arise from the incorporation of ferrous materials in the drill string. The present apparatus operates in ferrous pipe. This avoids the costly isolation step of installing an exotic alloy drill collar in the drill string. Such drill collar are relatively expensive. For example, a drill collar made of Inconel (an alloy trademark) is very expensive compared to a drill collar made of steel. The presently disclosed system avoids that costly requirement.

Consider now the steps necessary to construct a survey. For each depth, measurements from the four sensor outputs (highly refined averages) were made at a particular elevation in the well borehole with a specified orientation of the tool in the well borehole. A careful and detailed survey can be obtained by this procedure using M sets of data where M is an integer representing the number of measurement sets of N data for each sensor output recorded at M locations in the well. The typical operation records data where M equals one with the drill bit on bottom. The next (M=2) is measured when the first stand of pipe is pulled.

In the foregoing, each of the M measurements stations is located spaced from adjacent stations by one stand of pipe or approximately 90 feet. This dimension is well known. The data collected thus has M sets of data where M represents the number of stops made in retrieving the drill string. This provides M finite locations along the pathway of the borehole. The pathway can then represented in a three dimension plot of the well as a survey. The typical representation utilizes three variables, with one variable beginning depth in the well borehole of each of the M stops. In addition, the inclination and azimuth of the well borehole determined at each of the M stops thereby providing the remaining two variables required to define the position of each stop in three dimensional space. The three variables provide a useful representation of data which has the form of a survey as mentioned.

In another way of operation, the tool can be lowered in the well borehole to a desired depth, and the first of the M measurements is made with the drill bit at the bottom of the borehole and the sonde rested above the drill bit in the drill string. Then, the slickline is retrieved from the borehole by a specified measurement. If the well is 10,000 feet in depth, it is not uncommon to move the sonde 100 feet. In this instance, the M sets of measurements would be 100 or M=100. This enables operator control of the spacing of the data points along the survey. In a highly deviated well, the survey points may be quite close together. In a well which only deviates slightly, the survey points can be farther apart which permits a smaller value of M. In this particular instance, M and N can be selected by the operator. Loosely, they represent scale or spacing along the survey. As before, the survey typically is reported in the form of azimuth, inclination, and location along the well borehole. As noted with regard to FIGS. 3, 4 and 5, azimuth and inclination can be obtained from the data. Data quality is likewise obtained by noting the standard deviation. While the foregoing is directed to the preferred embodiment, the scope can be determined from the claims which follow.

We claim:

1. A method of obtaining a survey in a well borehole subject to deviation from the vertical which comprises the steps of:

a) positioning in a well borehole a rate gyro having an axis of rotation coincident with a sonde which supports said rate gyro, and moving said sonde along the well borehole and taking measurements at spaced locations to determine a reference north measurement by combining measurements made with said rate gyro at opposite azimuthal positions with respect to said axis of rotation;

b) measuring the direction of gravity along the sonde as it moves in the well borehole;

c) determining from said measurements at least two dimensions of the position of the sonde in the well borehole; and (d) determining the quality of said at least two determinations of the position of the sonde in the well borehole.

2. The method of claim 1 wherein true north is formed by two orthogonal signals.

3. The method of claim 2 including the step of locating gravity direction by making two orthogonal measurements.

4. The method of claim 3 including the step of determining sonde depth in the well borehole.

5. The method of claim 4 including the step of determining well azimuth for the survey.

6. The method of claim 5 including the step of determining well inclination for the survey.

7. The method of claim 6 including the step of making measurements recorded in memory in the sonde and retrieving the sonde to obtain data recorded in memory.

8. A method of obtaining a survey in a well borehole subject to deviation from the vertical which comprises the steps of:

a) positioning in a well borehole a rate gyro having an axis of rotation coincident with a sonde which supports said rate gyro, moving said sonde along the well borehole and making two orthogonal signal measurements at spaced locations, and determining a reference north measurement from said orthogonal signal measurements;

b) measuring the direction of gravity along the sonde during movement in the well borehole by making an additional two orthogonal signal measurement; and c) determining from said measurements at least two dimensions of the position of the sonde in the well borehole.

9. The method of claim 8 including the step of determining sonde depth in the well borehole.

10. The method of claim 9 including the step of determining well azimuth for the survey.

11. The method of claim 10 including the step of determining well inclination for the survey.

12. The method of claim 11 including the step of making measurements recorded in memory in the sonde and retrieving the sonde to obtain data recorded in memory.

13. A method of performing a survey of a well borehole comprising the steps of:

a) positioning an elongate sonde in a well borehole having a rate gyro therein rotating about an axis and forming an output indicative of north, and wherein said rate gyro is supported by a housing rotatable between first and second positions separated by 180° of housing rotation and said output indicative of north comprises N measurements are made at a first sonde position, then the housing is rotated by 180° and another N measurements is made where N is an integer;

b) positioning the sonde at spaced locations along a well borehole;

c) measuring the direction of the sonde along the well borehole; and d) combining the measurements to form a well borehole survey.

14. The method of claim 13 wherein N measurements are averaged to provide an average value prior to housing rotation, and the two averaged values are incorporated in the survey.

15. The method of claim 14 wherein measurement standard deviation is determined, and is included in the computed borehole survey data.

16. The method of claim 15 wherein rate gyro housing rotation occurs after N measurements are made thereby to enable said N measurements to be made in a selected time interval and a second set of measurements to be made in a second selected time interval.

17. The method of claim 16 wherein N measurements are made at first location in the well borehole; then, N measurements are made along the borehole at evenly spaced locations so that the borehole survey has a desired set of data points.

18. The method of claim 13 wherein the sonde is lowered to the bottom of a drill string in the well borehole on a slickline and the slickline is retrieved leaving the sonde in the well borehole.

19. The method of claim 18 wherein the sonde measures north and gravity direction while tripping the drill string out of the borehole.

20. The method of claim 19 wherein measurements are made spaced along the borehole by the length of a stand of pipe in the drill string.

21. The method of claim 13 wherein the sonde is lowered to the bottom of the borehole to enable a survey to be conducted, retrieving the sonde along the borehole, and making measurements along the borehole at spaced locations.

22. The method of claim 21 wherein the sonde is stopped at spaced locations along the borehole and measurements are made and stored in the sonde until retrieval to the surface.

23. The method of claim 18 wherein the slickline is disconnected from the sonde after lowering the sonde to the bottom of a drill string in the well borehole.

* * * * *